US011723453B2

(12) United States Patent
Farrell

(10) Patent No.: US 11,723,453 B2
(45) Date of Patent: Aug. 15, 2023

(54) BRUSH HEAD ASSEMBLY AND METHODS OF MANUFACTURE

(71) Applicant: KONINKLIJKE PHILIPS N.V., Eindhoven (NL)

(72) Inventor: Nathan Farrell, Kirkland, WA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 290 days.

(21) Appl. No.: 16/771,284

(22) PCT Filed: Dec. 4, 2018

(86) PCT No.: PCT/EP2018/083396
§ 371 (c)(1),
(2) Date: Jun. 10, 2020

(87) PCT Pub. No.: WO2019/115279
PCT Pub. Date: Jun. 20, 2019

(65) Prior Publication Data

US 2020/0375349 A1 Dec. 3, 2020

Related U.S. Application Data

(60) Provisional application No. 62/597,513, filed on Dec. 12, 2017.

(51) Int. Cl.
*A46D 3/04* (2006.01)
*A46D 3/00* (2006.01)
*A46B 9/04* (2006.01)

(52) U.S. Cl.
CPC ..... *A46D 3/045* (2013.01); *A46D 3/005* (2013.01); *A46B 9/04* (2013.01); *A46B 2200/1066* (2013.01)

(58) Field of Classification Search
CPC . A46D 3/005; A46D 3/08; A46D 3/04; A46D 3/045; A46D 3/05
(Continued)

(56) References Cited

U.S. PATENT DOCUMENTS 6,702,394 B2 * 3/2004 Boucherie ..... A46D 3/045 300/8
8,297,710 B2 10/2012 Sakurai
(Continued)

FOREIGN PATENT DOCUMENTS

CN 102834032 A 12/2012
DE 1029610 A1 3/1992
(Continued)

OTHER PUBLICATIONS

International Search Report and Written Opinion, International Application No. PCT/EP2018/083396, dated Mar. 22, 2019.

*Primary Examiner* — Laura C Guidotti

(57) ABSTRACT

A method (200) for manufacturing a brush head (10) includes: (i) positioning (210) a first end (23) of each of a plurality of bristle tufts (21) into a tuft plate (110) comprising a plurality of cavities (120) each configured to receive at least one of the plurality of bristle tufts; (ii) applying (220) a force, via a profile plate (300), to a second end (25) of the plurality of bristle tufts, wherein the profile plate comprises a predetermined shape complementary to a desired profile configuration of the bristle tufts; and (iii) applying (230) heat to each of the first ends of the plurality of bristle tufts, via a die plate (400) comprising at least one cavity (410) configured to receive at least one of the plurality of the first ends, at a temperature sufficient to at least partially melt each of the first ends into the cavity.

3 Claims, 10 Drawing Sheets

(58) Field of Classification Search
USPC ..... 300/2, 8, 21
See application file for complete search history.

(56) References Cited

U.S. PATENT DOCUMENTS

| | | | | |
|---|---|---|---|---|
| 8,915,552 | B2 | 12/2014 | Birk | |
| 10,376,349 | B2 | 8/2019 | Deane | |
| 11,147,658 | B2 | 10/2021 | Dengler | |
| 2001/0038237 | A1 | 11/2001 | Boucherie | |
| 2011/0225758 | A1 | 9/2011 | Chung | |
| 2011/0304194 | A1 | 12/2011 | Uchida | |
| 2013/0241267 | A1* | 9/2013 | Kumpf | A46D 3/045 300/4 |
| 2018/0289140 | A1* | 10/2018 | Dengler | A46B 3/06 |

FOREIGN PATENT DOCUMENTS

| | | | | |
|---|---|---|---|---|
| EP | 1136016 | A1 | 9/2001 | |
| EP | 2078472 | * | 7/2009 | A46B 3/06 |
| JP | 63163908 | U | 10/1988 | |
| JP | 0956476 | A | 3/1997 | |
| JP | 2002079551 | A | 3/2002 | |
| JP | 2003245970 | A | 9/2003 | |
| JP | 2006087128 | A | 3/2006 | |
| JP | 2012096421 | A | 5/2012 | |
| JP | 2015131441 | A | 7/2015 | |
| JP | 2017508542 | A | 3/2017 | |
| JP | 2017063811 | A | 4/2017 | |
| WO | 2006082799 | A1 | 8/2006 | |
| WO | WO2010025820 | A2 | 3/2010 | |
| WO | WO2011072865 | A1 | 6/2011 | |

* cited by examiner

BRUSH HEAD ASSEMBLY AND METHODS OF MANUFACTURE

This application is the U.S. National Phase application under 35 U.S.C. § 371 of International Application No. PCT/EP2018/083396, filed on 20 Jun. 2019, which claims the benefit of U.S. Provisional Application No. 62/597513, filed 12 Dec. 2017. These applications are hereby incorporated by reference herein.

FIELD OF THE INVENTION

The present disclosure is directed generally to a brush head assembly with bristle tufts retained within an elastomeric matrix, as well as to methods for manufacturing the brush head assembly.

BACKGROUND

Periodontal diseases are thought to be infectious diseases caused by bacteria present in dental plaques. Tooth brushing is a highly effective method to remove dental plaque from the teeth. Power toothbrushes can enhance the removal of dental plaque. Such power toothbrushes have a set of bristles attached to a brush head which is moved by a driver that causes the bristles to scrub dental surfaces.

The brush heads of both manual and power toothbrushes comprise bristles which are used to clean the teeth, tongue, and cheeks. In some toothbrushes, the non-anchored end of the bristles are organized into a desired brushing surface shape, and the anchored ends of the bristles are then fused together to form a head that is then fixed within a polymer such as a flexible thermoplastic elastomer (TPE). In other toothbrushes, the bristles are organized into bristle tufts contained within retention rings. The retention rings serve to secure the bristle tufts within the brush head and often have a hollow circular shape with an interior and exterior circular circumference. During manufacture, the bristle tufts are inserted into the hollow interior of the retention ring, and the bristles are then fused together using heat to form a head which cannot be pulled out through the retention ring.

Often, however, the fused bristles and/or retention rings are not firmly secured within the brush head. As a result, the bristles can be or become loose within the brush head, and the bristles might not always be positioned at an angle optimal for brushing. As such, under the dynamic conditions of motion induced by the power toothbrush operation, for example, the bristle tuft structure can undergo higher stresses under the dynamic motion, which could lead to separation. Further, the process of organizing the bristles into tufts, heating the ends and then cooling the brush head material, or allowing it to cool, in order to fix the tufts in place can be time-consuming and expensive.

Accordingly, there is a need in the art for improved brush head assemblies, and methods of their manufacture, that permanently and efficiently retain bristles within the brush head.

SUMMARY OF THE INVENTION

The present disclosure is directed to inventive methods for manufacturing a brush head with secured bristle tufts. Various embodiments and implementations herein are directed to manufacturing methods in which bristle tufts are affixed within an elastomeric matrix resulting in a completed brush head. Using the various embodiments and implementations herein, cost-effective and efficient production of brush heads with secured bristle tufts is substantially improved. Bristle tufts are positioned into positioning cavities of a tuft plate, and a force is applied to one end of each of the bristle tufts via a profile plate on one side of the tuft plate. On the opposite side of the tuft plate, the other ends of the bristle tufts are heated by a die plate comprising shaping cavities. The heated ends at least partially melt into the respective shaping cavity, thereby adopting the shape of the cavity. The shaped ends of the bristle tufts are then cooled and ejected from the die plate. According to an embodiment, the profile plate applies pressure to the ends of the bristle tufts until the ends adopt a desired profile configuration.

Generally in one aspect, a method for manufacturing a brush head is provided. The method includes: (i) positioning a first end of each of a plurality of bristle tufts into a tuft plate, the tuft plate comprising a plurality of cavities each configured to receive at least one of the plurality of bristle tufts; (ii) applying a force, via a profile plate, to a second end of each of the plurality of bristle tufts, wherein the profile plate comprises a predetermined shape complementary to a desired profile configuration of the bristle tufts; and (iii) applying heat to each of the first ends of the plurality of bristle tufts, via a die plate comprising at least one cavity configured to receive at least one of the plurality of the first ends, at a temperature sufficient to at least partially melt each of the first ends into the cavity, wherein each first end of the plurality of bristle tufts adopts the shape of the cavity, wherein the force is applied via the profile plate until the second ends of the plurality of bristle tufts adopt the desired profile configuration.

According to an embodiment, the force is applied via the profile plate until one or more of the plurality of bristles achieves a predetermined length between the die plate and the profile plate.

According to an embodiment, the at least one cavity of the die plate comprises a channel configured to receive excess melted bristle tuft.

According to an embodiment, the method further includes the step of cooling the die plate until the shaped first ends of the plurality of bristle tufts solidify. According to an embodiment, the die plate is cooled via an airjet or liquid cooling.

According to an embodiment, the method further includes the step of ejecting the shaped first ends of the plurality of bristle tufts from the die plate. According to an embodiment, the shaped first ends are ejected via ejection pins. According to an embodiment, the shaped first ends are ejected via air pressure According to an embodiment, the method further includes the step of molding a thermoplastic elastomer to create an elastomeric matrix that at least partially encompasses the shaped first ends of the plurality of bristle tufts.

According to an aspect is a system for manufacturing a brush head. The system includes: (i) a tuft plate comprising a plurality of tuft plate cavities each configured to receive a bristle or bristle tuft; (ii) a profile plate comprising a predetermined shape complementary to a desired final profile configuration of the bristle tufts, wherein the profile plate is configured to apply a force to a second end of a bristle or bristle tuft positioned within the tuft plate; and (iii) a die plate comprising at least one die plate cavity configured to receive a first end of a bristle or bristle tuft positioned within the tuft plate, wherein the die plate is configured to heat to the first ends of the bristle or bristle tufts at a temperature sufficient to at least partially melt each of the first ends into the cavity.

According to an embodiment, the profile plate is configured to apply the force until the second ends of the plurality of bristle tufts adopt the desired profile configuration, and/or until one or more of the plurality of bristles achieves a predetermined length between the die plate and the profile plate.

According to an embodiment, of the at least one cavity of the die plate comprises a channel configured to receive excess melted bristle tuft.

According to an embodiment, the die plate is further configured to cool the melted first ends of the plurality of bristle tufts until the melted first ends solidify.

According to an embodiment, the die plate is further configured to eject the melted first ends of the plurality of bristle tufts from the die plate.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a brush head assembly with bristle tufts retained within an elastomeric matrix, and methods of their manufacture. More generally, Applicants have recognized and appreciated that it would be beneficial to provide a brush head formed with bristles permanently embedded in an elastomeric matrix in order to improve bristle retention. According to an embodiment bristle tufts are positioned into a tuft plate, and force is applied to one end of each of the bristle tufts via a profile plate on one side of the tuft plate while the other ends of the bristle tufts are heated by a die plate comprising shaping cavities. The heated ends at least partially melt into the respective shaping cavity, thereby adopting the shape of the cavity. The shaped ends of the bristle tufts are then cooled and ejected from the die plate. According to an embodiment, the profile plate applies pressure to the ends of the bristle tufts until the ends adopt a desired profile configuration.

The brush heads disclosed and described herein can be used with various types of brushes, and more specifically, with any manual or power toothbrush device.

Figure 1:
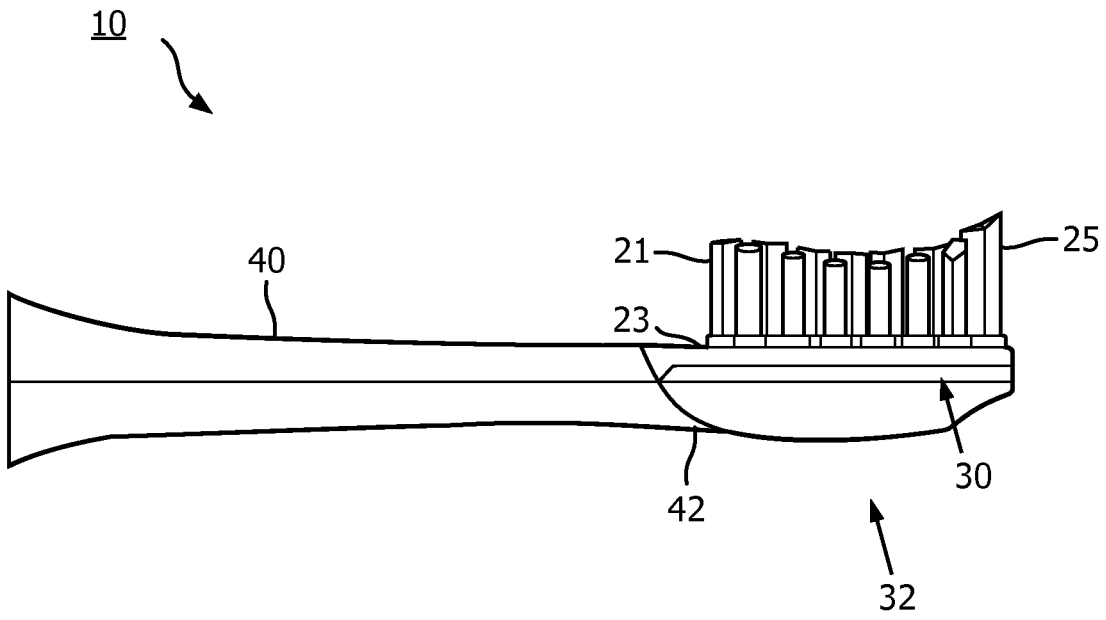
FIG. 1 is a schematic representation of a side view of a brush head assembly, in accordance with an embodiment.

Referring to FIG. 1, in one embodiment, a schematic representation of a brush head assembly 10 is provided. The brush head assembly includes a neck 40, which can be coupled to any manual brush shaft, or, more preferably, to any actuator and drive shaft (not shown) made or suitable for powered oral care devices now known or to be developed. The brush head 32 of the brush head assembly includes a plurality of bristle tufts 21, each of which comprises a plurality of bristle strands. According to an embodiment, the bristle tufts are composed of nylon, or another suitable material, and optionally can be coated with polyurethane, polybutylene terephthalate (PBT), polyolefin, combinations of these, or a similar polymer.

Each bristle tuft 21 has a first end 23 retained within the brush head assembly 10. The first end of the bristle tufts and the portion of the neck that is the brush neck 42 are retained within a flexible elastomeric matrix 30 to form a head portion 32 of the brush head assembly 10. According to an embodiment, the elastomeric matrix 30 is preferably made from a flexible thermoplastic elastomer (TPE), and the retention rings are preferably made from thermoplastic polymer such as polypropylene. The neck 40 and the brush neck 42 are preferably made from a material with a higher elastic modulus value than the elastomeric matrix 30. The second end 25 of each bristle tuft 21 is the portion of the bristles that are used in operation, such as to clean a user's teeth.

Figure 2:
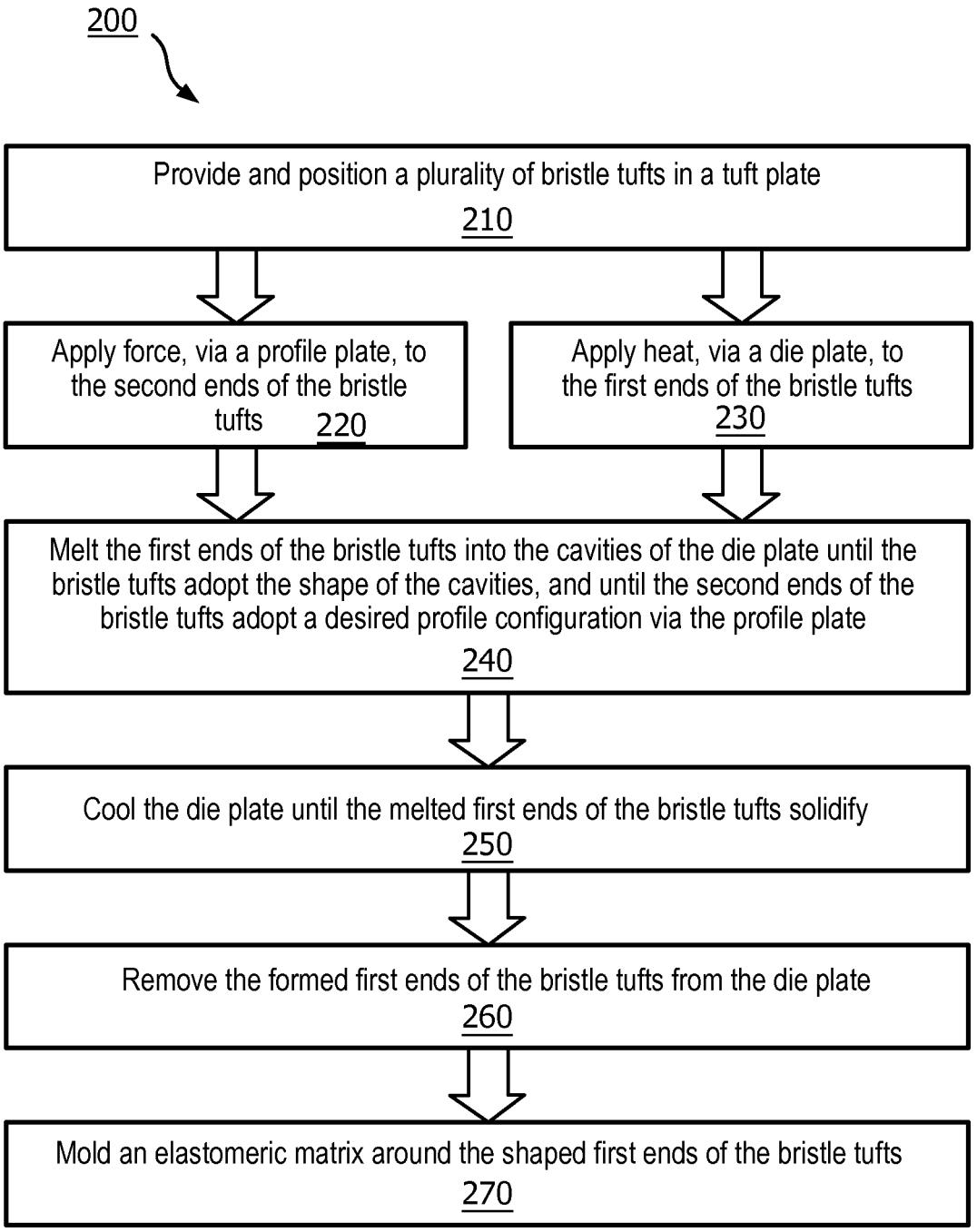
FIG. 2 is a flowchart of a method for manufacturing a brush head assembly with bristle tufts retained within an elastomeric matrix, in accordance with an embodiment.

Referring to FIG. 2, in one embodiment, is a method 200 for manufacturing one or more of the various brush head embodiments and implementations described or otherwise envisioned herein. For example, brush head 32 can comprise a plurality of bristle tufts 21 each having a first end 23 and a second end 25, where the first end of each bristle tuft is retained within a flexible elastomeric matrix 30 of the brush head assembly 10. According to an embodiment, the first end portions 23 of the bristles are shaped to increase engagement with the elastomeric matrix 30, and/or to increase the force needed to remove the bristle tuft from the elastomeric matrix. Many other embodiments and configurations of the brush head 32 are possible.

Figure 3:
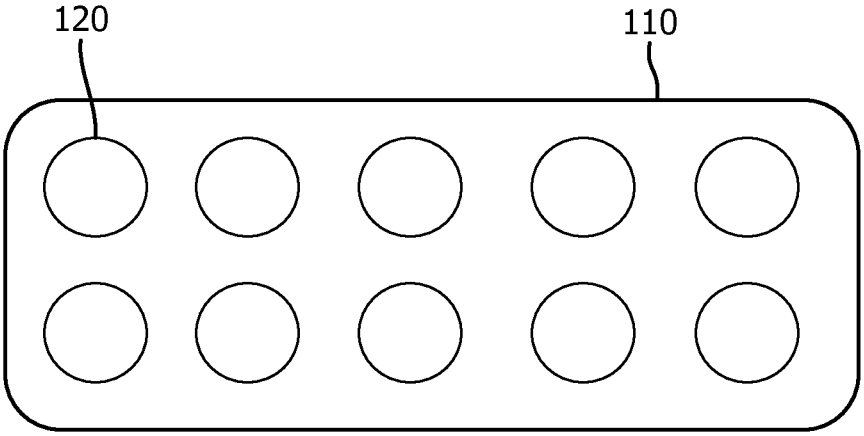
FIG. 3 is a schematic representation of a tuft plate, in accordance with an embodiment.
Figure 4:
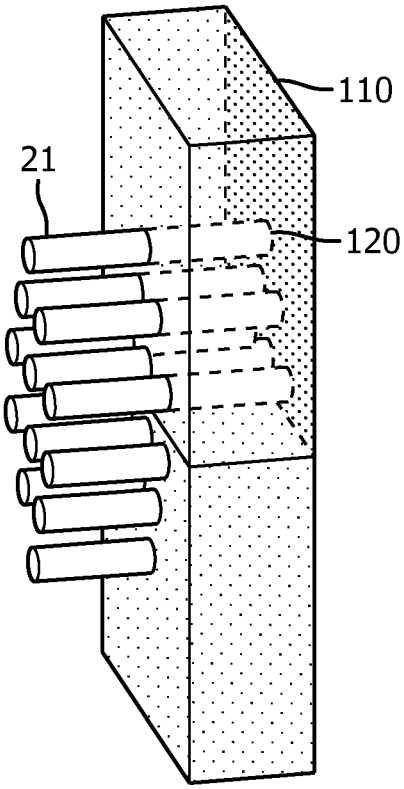
FIG. 4 is a schematic representation of a tuft plate with positioned bristle tufts, in accordance with an embodiment.

At step 210 of the method, the first end 23 of each of the bristle tufts 21 is positioned into a tuft plate, which includes one or more cavities. The cavity is, or each of the plurality of cavities are, configured to receive at least one of the plurality of bristle tufts. The cavity may receive a single bristle, a single bristle tuft, a plurality of bristle tufts, or all the bristle tufts. Referring to FIG. 3, in one embodiment, is a top view of a tuft plate 110 with a plurality of tuft cavities 120 into which a bristle or bristle tuft 21 is inserted. Referring to FIG. 4, in one embodiment, is a side perspective view of a tuft plate 110 with a plurality of bristles or bristle tufts 21 inserted into the tuft cavities 120.

At step 220 of the method, a force is applied to the second ends 25 of the bristle tufts 21 by a profile plate 300. Prior to or simultaneously with this step, the first ends 23 of the bristle tufts 21 are aligned with or into cavities 410 of a die plate 400. Accordingly, in a preferred embodiment, the cavities 120 of the tuft plate 110 and the cavities 410 of the die plate 400 align such that tufts passing through the cavities of the tuft plate can align with and enter into the cavities of the die plate.

According to an embodiment, profile plate 300 comprises a predetermined shape or profile which is complementary to a desired profile configuration of the bristle tufts. For example, many toothbrush bristle tufts present a contoured profile that is designed to improve brushing efficacy. The profile plate adopts a configuration complementary to the desired bristle contoured profile such that as the profile plate pushes against or is pushed against the second ends 25 of the bristle tufts, the plurality of bristle tufts can adopt the desired contoured profile. The contoured profile may be any desired profile, including curved, straight, multi-layered, and many other profiles.

According to an embodiment, the profile plate 300 may comprise one plate or a plurality of plates, including a plurality of pins configured to apply pressure to individual bristles or bristle tufts. Other methods or systems for applying a force to the bristles by one or more profile plate embodiments are possible.

Figure 5:
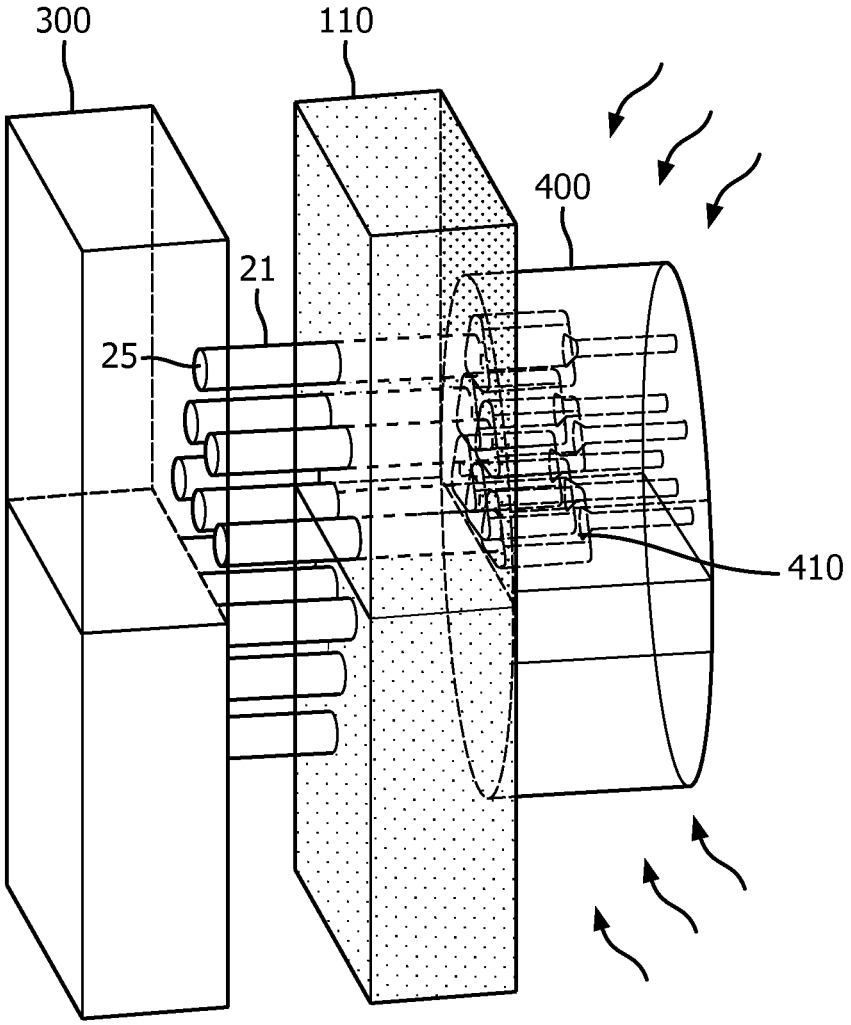
FIG. 5 is a schematic representation of a profile plate, tuft plate, and die plate, in accordance with an embodiment.
Figure 6:
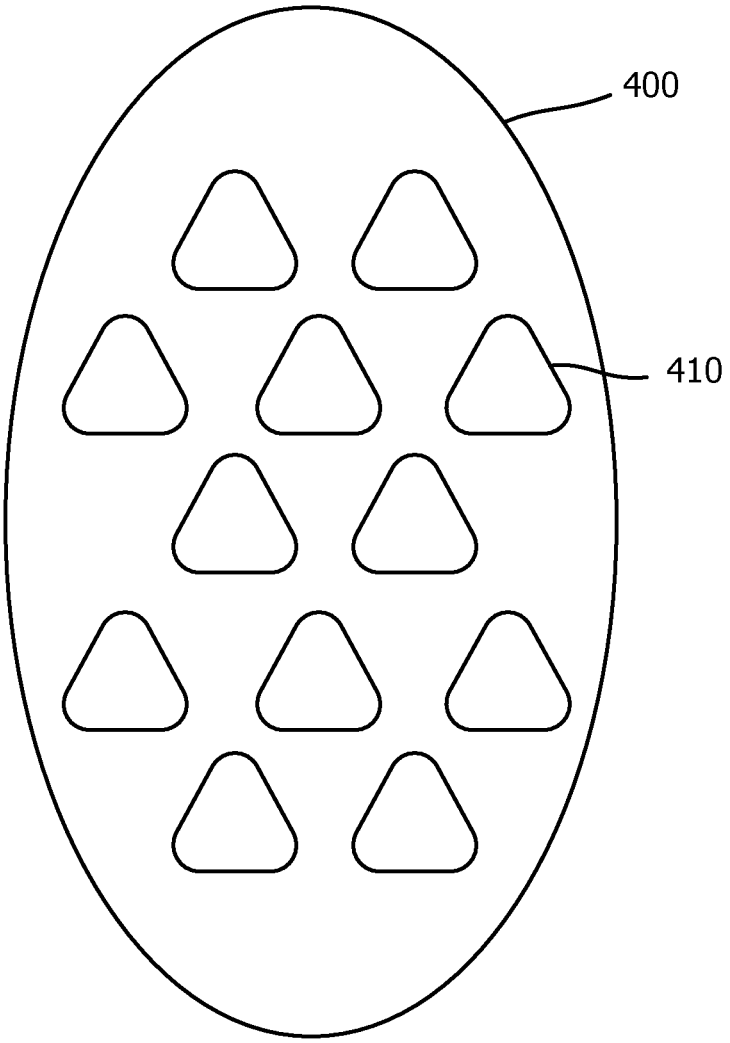
FIG. 6 is a schematic representation of a die plate, in accordance with an embodiment.

Referring to FIG. 5, in one embodiment, is a schematic representation of a tuft plate 110 positioning a plurality of bristle tufts 21 via the tuft plate cavities 120. On one side of the tuft plate 110 is the profile plate 300 with a predetermined shape or profile which is complementary to a desired profile configuration of the bristle tufts. On the opposite side of the tuft plate is the die plate 400 comprising a plurality of die plate cavities 410 into which the first ends 23 of the bristle tufts 21 are inserted. The die plate cavities 410 can comprise any shape into which the melting first ends of the bristles will adopt. Accordingly, the die plate cavities can be round, square, triangular, rectangular, oval, or any other size or shape. Referring to FIG. 6, in one embodiment, is a die plate 400 comprising a plurality of triangular die plate cavities 410. The die plate cavities may optionally comprise an additional structure, including but not limited to rings, around and/or through which the first ends 23 of the bristle tufts 21 may pass or interact. The additional structure and the first ends of the bristle tufts may fuse, mechanically interlock, or otherwise adopt another desired configuration as the first ends of the bristles melt in downstream steps of the method.

At step 230 of the method, the die plate 400 applies heat to the first ends 23 of the plurality of bristle tufts 21 at a temperature sufficient to at least partially melt each of the first ends into the respective cavity with which it is aligned. For example, the die plate can be heated by an external heat source, or can comprise an internal or attached heat source. The heating temperature will depend on the material from which the bristles are manufactured, and/or the speed with which the first ends should melt, and/or one or more other factors. As the first ends 23 of the bristle tufts melt, the bristles in the bristle tufts fuse and also adopt the shape of the die plate cavity 410 into which the first ends have been inserted. This is further facilitated by the force exerted on the second ends 25 of the bristle tufts by the profile plate 300, as this pushes the bristles in a direction toward the die plate cavities, promoting the melting first ends to adopt the shape of the die plate cavity.

Figure 7:
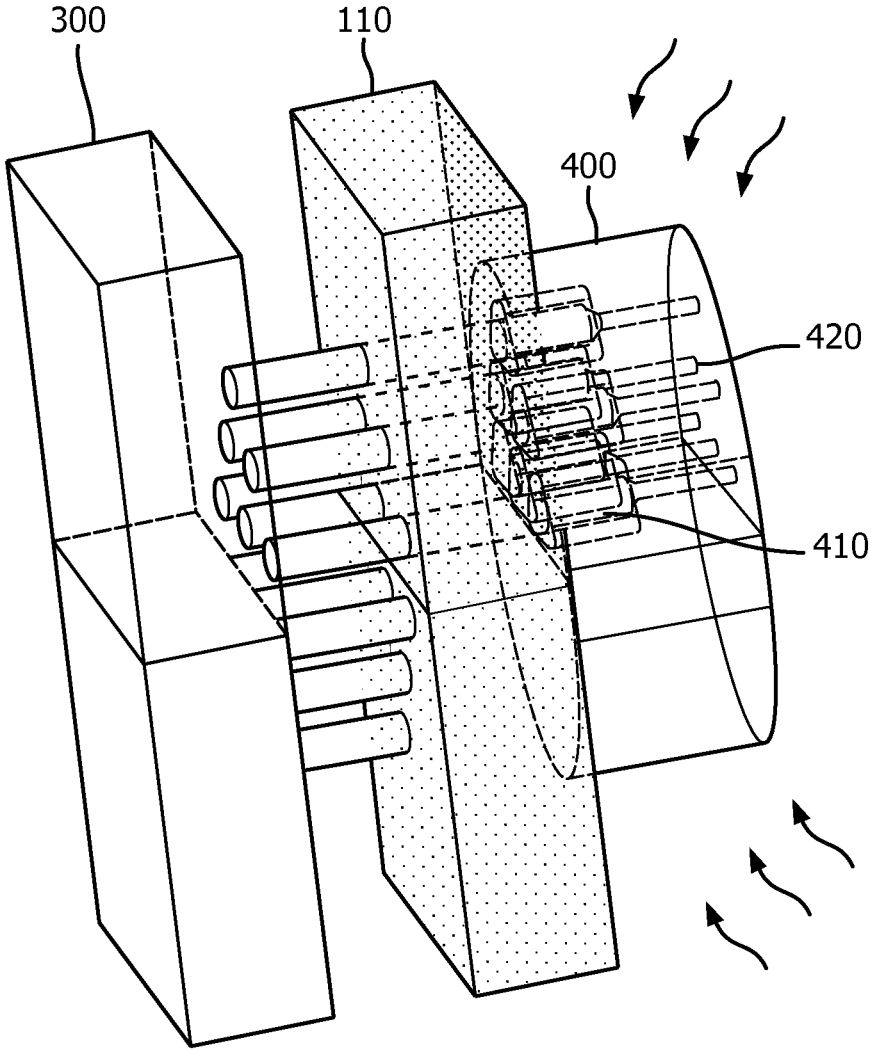
FIG. 7 is a schematic representation of a profile plate, tuft plate, and die plate, in accordance with an embodiment.

According to an embodiment, one or more of the die plate cavities 410 comprises a channel 420, as shown in FIG. 7, configured to receive excess melted bristle tuft. As the profile plate pushes the second ends 25 of the bristle tufts and the die plate heats the firsts ends 23, the first ends melt and fill the die plate cavity 410. However, if there is more melted bristle than the cavity is sized to receive, the excess melted bristle can escape the cavity via the channels 420.

For example, the contoured profile adopted by the second ends of the bristles due to the force of the profile plate may require that some bristles are shorter than others. Thus, the die plate cavities for the shorter bristles will by necessity have to receive more melted bristle than die plate cavities for longer bristles. Although the die plate cavities may be configured to receive an exact amount of melted bristle based at least in part on the desired profile configuration of the second ends, in other embodiments, one or more of the die plate cavities 410 can include a channel 420 configured to receive any excess melted bristle tuft. In this way, a die plate can accommodate a plurality of different profiles for the second ends of the bristles, as well as a plurality of different bristle tuft lengths for the device.

Referring to FIG. 7, in one embodiment, is a schematic representation of a profile plate 300 exerting a force on the second ends 25 of the bristle tufts, positioned by the tuft plate 110, as the die plate 400 heats the first ends 23 of the bristle tufts. Comparing FIGS. 5 and 7, for example, the bristle tufts are shortening as force and heat are applied to the opposite ends of the bristle tufts. The die plate 400 comprises a plurality of die plate cavities 410 into which the melted bristle tufts fill, and one or more of the die plate cavities comprise a channel 420 to receive excess melted bristle tuft.

At step 240 of the method, the profile plate 300 applies the force until the second ends 25 of the plurality of bristle tufts 21 adopt the desired profile configuration. The profile plate may also apply force until the bristles adopt a predetermined length between the die plate and the profile plate. Once the desired length and/or profile configuration is adopted, the profile plate may stop applying the force, and/or the die plate may stop heating the bristles.

Figure 8:
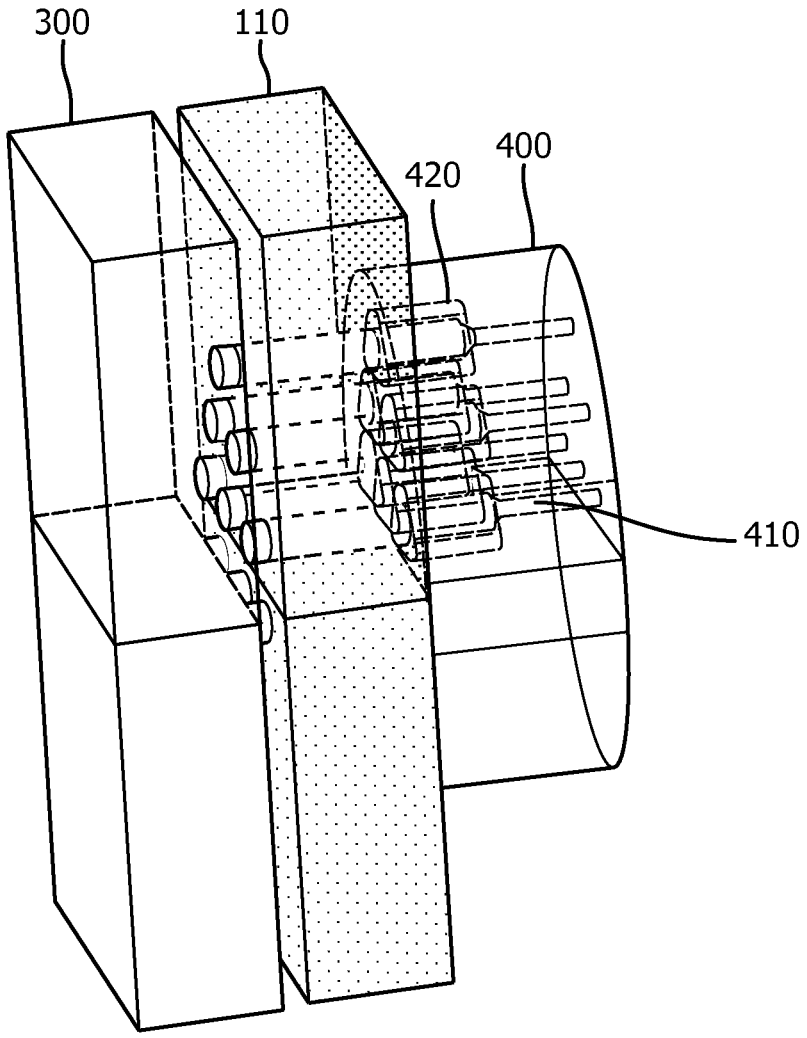
FIG. 8 is a schematic representation of a profile plate, tuft plate, and die plate, in accordance with an embodiment.

Referring to FIG. 8, in one embodiment, is a schematic representation of a profile plate 300 exerting a force on the second ends 25 of the bristle tufts 21, positioned by the tuft plate 110, as the die plate 400 heats the first ends 23 of the bristle tufts 21. The profile plate 300 has exerted a force on the second ends 25 of the bristle tufts 21 until the bristle tufts 21 have adopted a predetermined desired length and/or configuration.

Figure 9:
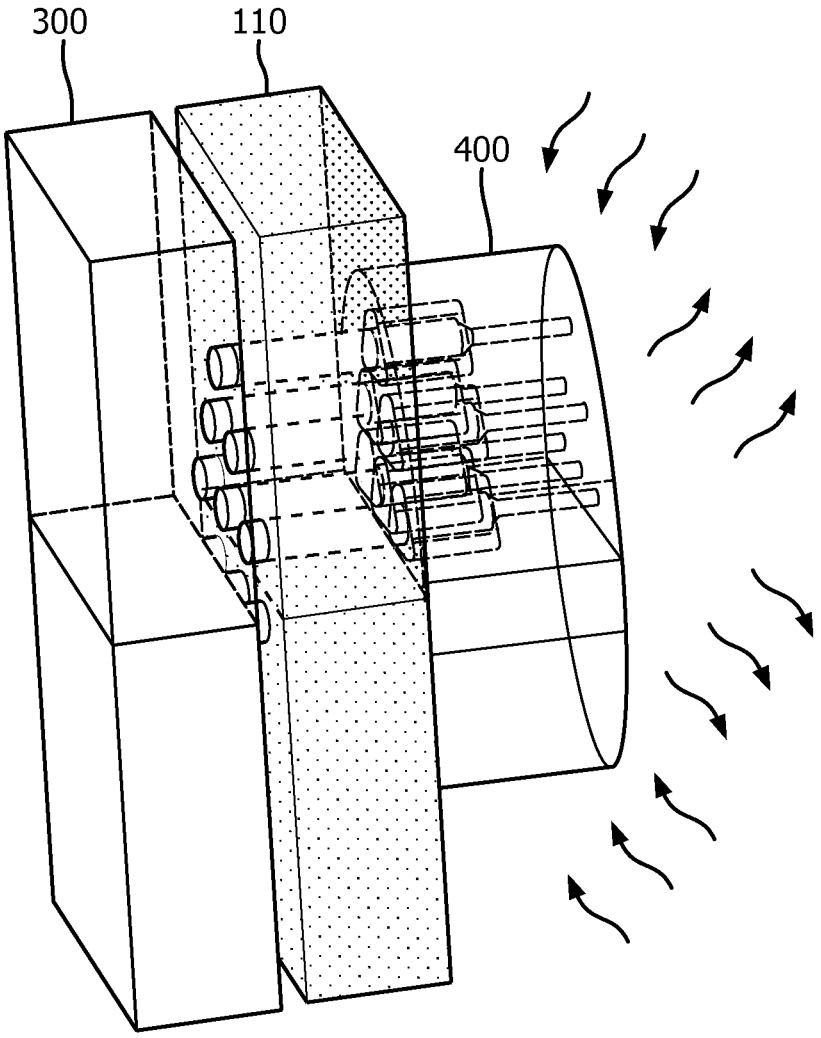
FIG. 9 is a schematic representation of a profile plate, tuft plate, and die plate, in accordance with an embodiment.

At step 250 of the method, the die plate 400 is cooled until the melted first ends of the plurality of bristle tufts, positioned within the die plate cavities 410, solidify. For example, the die plate may be cooled by air jet, liquid cooling, or by any other method. The die plate or first ends may be cooled for a predetermined amount of time, or until the first ends are determined to be sufficiently solidified. Referring to FIG. 9, in one embodiment, is a schematic representation of the profile plate 300, tuft plate 110, and die plate 400 in which the die plate is being actively or passively cooled to allow the melted and shaped first ends to cool and solidify.

At step 260 of the method, the shaped bristle tufts are removed from the die plate, by ejection or other method. For example, the shaped bristle tufts may be removed by pulling on the tuft plate 110. Alternatively or additionally, the shaped bristle tufts may be removed by exerting a force on the first ends 23 via ejection pins and/or air pressure.

Figure 10:
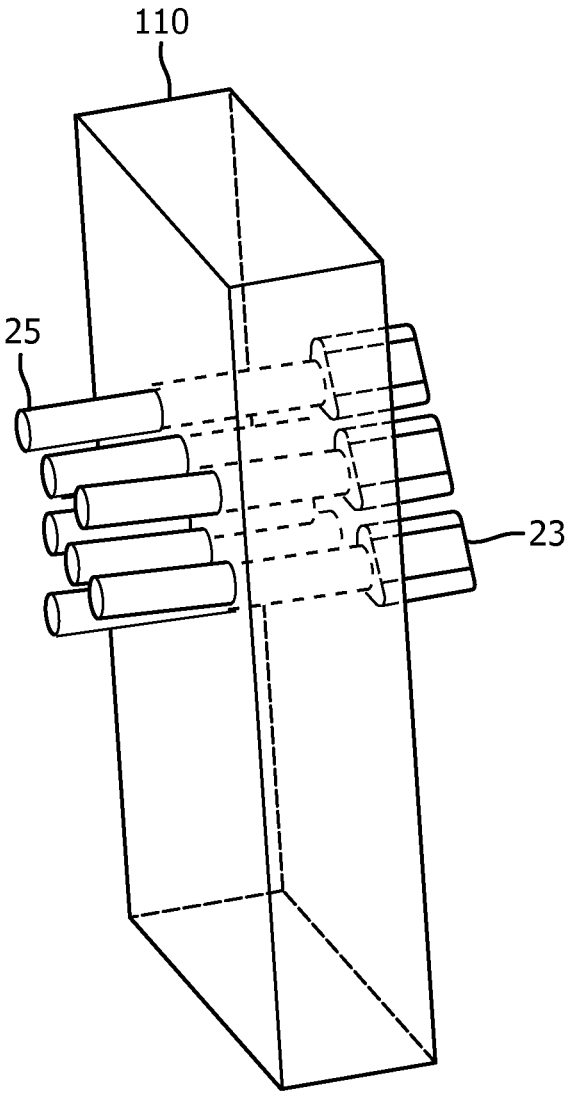
FIG. 10 is a schematic representation of shaped bristles in a tuft plate and ejected from a die plate, in accordance with an embodiment.

Referring to FIG. 10, in one embodiment, is a schematic representation of a tuft plate 110 with a plurality of bristle tufts in which the first ends 23 have adopted the shape of the die cavities of the die plate 400, and the second ends 25 have adopted the contour or configuration of the profile plate 300.

At step 270 of the method, an elastomeric material is molded over the brush neck 42 and the shaped first ends 23 of the bristle tufts to form an elastomeric matrix 30. According to an embodiment, elastomeric matrix 30 is preferably made from a flexible thermoplastic elastomer. The brush neck 42 may be positioned in relation to the first ends 23 of the bristle tufts. Brush neck 42 can be properly positioned using a mold, for example, or other positioning mechanism. According to an embodiment, the hard brush neck 42 can be designed to promote fusing of the elastomeric matrix to the brush neck. For example, if the brush neck is made from materials such as Spandex®, PolyMeg®, or similar copolymers, this would allow fusing of the elastomer matrix to the brush neck, thereby increasing retention forces. In addition, this design provides additional flexibility to the bristle tuft within the brush neck, and therefore additional degrees of freedom of motion within the brush head. However, many other materials and configurations for the brush neck 42 are possible.

Figure 11:
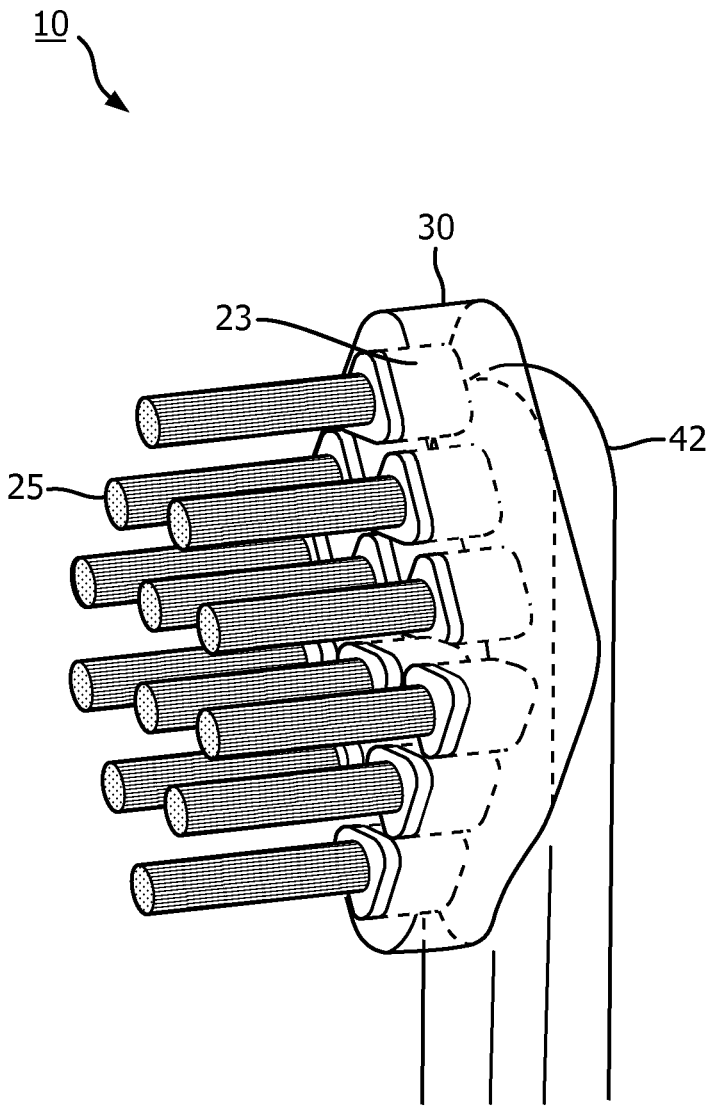
FIG. 11 is a schematic representation of shaped bristles embedded within an elastomeric matrix, in accordance with an embodiment.

Referring to FIG. 11, in one embodiment, is a schematic representation of a portion of a brush 10 with a plurality of bristle tufts each having a first end 23 which has adopted a melted shape, and a second end 25 which has adopted a desired profile configuration. The shaped first ends of the bristles have been embedded by an elastomeric matrix 30 formed around the first ends and the brush neck 42. The shaped ends of the bristles increase retention of bristle tufts in the finished brush head after the elastomeric matrix is molded around the components.

According to an embodiment, the methods described or otherwise envisioned herein enable the first ends of the bristle tufts to adopt any design according to the design of the die plate cavities. The melted shaped first ends of the bristle tufts can be visible if a portion extends out of the elastomeric matrix. The methods described or otherwise envisioned herein also enable the first ends of the bristle tufts to be embedded in the elastomeric matrix or other retaining mechanism without rings or other additional structure. The methods described or otherwise envisioned herein also enable the second ends of the bristle tufts to adopt any design according to the design of the profile plate.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for manufacturing a brush head, the method comprising the steps of:

positioning a first end of each of a plurality of bristle tufts into a tuft plate, the tuft plate comprising a plurality of cavities each configured to receive at least one of the plurality of bristle tufts;

applying a force, via a profile plate, to a second end of each of the plurality of bristle tufts, wherein the profile plate comprises a predetermined shape complementary to a desired profile configuration of the bristle tufts;

applying heat to each of the first ends of the plurality of bristle tufts, via a die plate comprising at least one cavity configured to receive at least one of the plurality of the first ends of the bristle tufts, at a temperature sufficient to at least partially melt each of the first ends into the cavity, wherein each first end of the plurality of bristle tufts adopts the shape of the cavity; and removing the shaped first ends of the plurality of bristle tufts from the die plate; wherein the shaped first ends are removed via ejection pins.

2. A method for manufacturing a brush head, the method comprising the steps of:

positioning a first end of each of a plurality of bristle tufts into a tuft plate, the tuft plate comprising a plurality of cavities each configured to receive at least one of the plurality of bristle tufts;

applying a force, via a profile plate, to a second end of each of the plurality of bristle tufts, wherein the profile plate comprises a predetermined shape complementary to a desired profile configuration of the bristle tufts;

applying heat to each of the first ends of the plurality of bristle tufts, via a die plate comprising at least one cavity configured to receive at least one of the plurality of the first ends of the bristle tufts, at a temperature sufficient to at least partially melt each of the first ends into the cavity, wherein each first end of the plurality of bristle tufts adopts the shape of the cavity; and removing the shaped first ends of the plurality of bristle tufts from the die plate, wherein the shaped first ends are removed via air pressure.

3. A system for manufacturing a brush head, the system comprising:

a tuft plate comprising a plurality of tuft plate cavities each configured to receive a bristle or bristle tuft;

a profile plate comprising a predetermined shape complementary to a desired final profile configuration of the bristle tufts, wherein the profile plate is configured to apply a force to a second end of a bristle or bristle tuft positioned within the tuft plate; and a die plate comprising at least one die plate cavity configured to receive a first end of a bristle or bristle tuft positioned within the tuft plate, wherein the die plate is configured to heat to the first ends of the bristle or bristle tufts at a temperature sufficient to at least partially melt each of the first ends into the cavity, wherein the die plate is further configured to cool the melted first ends of the plurality of bristle tufts until the melted first ends solidify, and to remove the solidified first ends of the plurality of bristle tufts from the die plate, and wherein the die plate is configured to eject the melted first ends of the plurality of bristle tufts from the die plate via ejection pins and/or air pressure.

* * * * *